US006454879B1

(12) United States Patent
Aigner et al.

(10) Patent No.: US 6,454,879 B1
(45) Date of Patent: Sep. 24, 2002

(54) PROCESS FOR PRODUCING A PARAMAGNETIC, CORROSION-RESISTANT MATERIAL AND LIKE MATERIALS WITH HIGH YIELD STRENGTH, STRENGTH, AND DUCTILITY

(75) Inventors: Herbert Aigner, Buchbach (AT); Günter Hochörtler, Kapfenberg (AT); Josef Bernauer, Kapfenberg (AT)

(73) Assignees: Schoeller-Bleckman Oilfield Technology GmbH & Co. KG, Ternitz (AT); Bohler Edelstahl GmbH & Co. KG, Kanfenberg (AT)

( * ) Notice: Subject to any disclaimer, the term of this patent is extended or adjusted under 35 U.S.C. 154(b) by 0 days.

(21) Appl. No.: 09/617,541

(22) Filed: Jul. 14, 2000

(30) Foreign Application Priority Data

Jul. 15, 1999 (AT) ..... 1232/99

(51) Int. Cl.[7] ..... H01F 1/147; C22C 38/18

(52) U.S. Cl. ..... 148/306; 148/307; 148/310; 420/56; 420/64; 420/583; 420/584

(58) Field of Search ..... 148/306, 307, 148/310; 420/56, 57, 58, 59, 60, 61, 64, 65, 67, 581, 583, 584

(56) References Cited

U.S. PATENT DOCUMENTS

| | | | | |
|---|---|---|---|---|
| 3,847,599 | A | * | 11/1974 | Hartline |
| 3,907,551 | A | * | 9/1975 | Hartline |
| 3,936,297 | A | * | 2/1976 | Hartline |
| 3,938,990 | A | * | 2/1976 | Hartline |
| 4,217,136 | A | * | 8/1980 | Hartline |
| 4,493,733 | A | * | 1/1985 | Yamamoto et al. |
| 4,888,153 | A | | 12/1989 | Yabuki et al. |
| 4,919,728 | A | | 4/1990 | Kohl et al. |
| 4,935,027 | A | | 6/1990 | Yoon |
| 5,094,812 | A | | 3/1992 | Dulmaine et al. |
| 5,308,577 | A | | 5/1994 | Dulmaine et al. |

FOREIGN PATENT DOCUMENTS

| | | |
|---|---|---|
| DE | 3143096 | 5/1982 |
| EP | 207068 | 12/1986 |
| EP | 0207068 | 12/1986 |
| EP | 0249117 | 12/1987 |
| EP | 0432434 | 6/1991 |
| EP | 0577898 | 1/1994 |
| EP | 1069202 | 1/2001 |
| JP | 6455332 | 3/1989 |
| WO | 91/02490 | 3/1991 |
| WO | 91/16469 | 10/1991 |
| WO | 98/48070 | 10/1998 |

OTHER PUBLICATIONS

Der Stahlschlüssel (Key to Steel), Verlag Stahlschlüssel Wegst GmbH, 18. Auflage 1998, ISBN 3–922599–15–X, Kurzname X1MnCrMoCu25–17–1 (p. 483), Kurzname X8CrMnMoN18–18–2 (p. 486) (1998).

Steel and its Heat Treatment: Bofors Handbook, pp. 51–53 (1978).

* cited by examiner

*Primary Examiner*—John Sheehan
(74) *Attorney, Agent, or Firm*—Greenblum & Bernstein, P.L.C.

(57) ABSTRACT

An austenitic, paramagnetic and corrosion-resistant material, particularly in media with high chloride concentrations, the material having high strength, yield strength, and ductility, including carbon, silicon, chromium, manganese, nitrogen, and optionally, nickel, molybdenum, copper, boron, and carbide-forming elements. The material is preferably substantially completely austenitic. A process utilizing alloying technology that includes a deformation and synergistically results in production of a ferrite-free material that is reliably paramagnetic, is corrosion-resistant, and has high yield strength, strength, and ductility. The material can be very beneficially used, for example, in connection with oil field technology, such as for bore rods and drilling string components as well as for precision-forged components, and for high strength attachment and connection elements.

36 Claims, No Drawings

PROCESS FOR PRODUCING A PARAMAGNETIC, CORROSION-RESISTANT MATERIAL AND LIKE MATERIALS WITH HIGH YIELD STRENGTH, STRENGTH, AND DUCTILITY

CROSS-REFERENCE TO RELATED APPLICATION

The present application claims priority under 35 U.S.C. § 119 of Austrian Patent Application No. 1232/1999, filed on Jul. 15, 1999, the disclosure of which is expressly incorporated by reference herein in its entirety.

BACKGROUND OF THE INVENTION

1. Field of the Invention

The invention relates to austenitic, paramagnetic and corrosion-resistant materials, particularly in media with high chloride concentrations, and materials having high strength, yield strength, and ductility. The invention further relates to processes for producing such materials and methods of using such materials.

2. Discussion of Background Information

High-strength materials that are paramagnetic, corrosion-resistant and, for economic reasons, essentially consist of alloys of chromium, manganese, and iron are used for manufacturing chemical apparatus, in devices for producing electrical energy, and in particular for components, devices and equipment in oil field technology. Increasingly high demands are being placed on the chemical corrosion properties as well as the mechanical characteristics of materials used in this manner.

In essentially all of the applications named above, it is indispensable for the behavior of the material to be completely homogeneous, highly amagnetic, or paramagnetic. For example, in cap rings of generators with high yield strength and ductility, a possibly low-level ferromagnetic behavior must be excluded with utmost certainty, including in parts of the material. For measurements during drilling, in particular exploration wells in crude oil or natural gas fields, drill stems made of materials with magnetic permeability values below about 1.02 or possibly less than 1.018 are necessary in order to be able to follow the exact position of the bore hole and to ascertain and correct deviations from its projected course.

It is furthermore necessary for devices in oil field technology and drill stem components to have high mechanical strength, in particular a high 0.2% yield strength in order to achieve machinery and plant engineering advantages and a high degree of operational reliability. In many cases, high fatigue strength under reversed stresses is just as important because, during rotation of a part and/or drill stems, pulsating or alternating stresses may be present.

Finally, the corrosion behavior of the material in aqueous or oily media, in particular media having high chloride concentrations, is critically important.

As a result of the demands of recent developments in plants and deep drilling technology, increasingly strict criteria are being placed on materials in terms of the combination of paramagnetic behavior, high yield strength, as well as strength, resistance to chloride-induced stress corrosion, pitting corrosion (pitting) and crevice corrosion.

Some materials made from Cr—Mn—Fe alloys are known which, with respect to their mechanical characteristics and corrosion behavior, completely fulfill these requirements, but whose magnetic permeability values prevent their use in parts used in connection with magnetic measurements and, for example, exclude their use for drill stems. On the other hand, available amagnetic materials with good strength characteristics cannot resist attacks by corrosion and, for the most part, paramagnetic parts with high corrosion resistance often do not have the necessary high mechanical values.

It is known to use nitrogen content to improve mechanical and chemical corrosion properties of substantially Cr—Mn—Fe alloys; however, expensive metallurgic processes operating at elevated pressure are necessary therefor.

For economic reasons, Cr—Mn—Fe alloys have been developed that can be produced without pressurized smelting or similar casting processes, i.e., at atmospheric pressure (WO 98/48070), in which a desired characteristic profile of the material is to be achieved using alloying technology. For the purpose of improving corrosion resistance, these alloys have a molybdenum content of over 2% which results in advantages, in particular in pitting and crevice corrosion behavior. However, molybdenum, like chromium, is a ferrite former and can lead to unfavorable magnetic characteristics in the material in segregation areas. While increased nickel contents stabilize the austenite, possibly in conjunction with increased copper concentrations, they may have a detrimental effect on the mechanical characteristics and also intensify crack initiation.

According to PCT/US91/02490, an attempt is made to use a balanced concentration of alloy elements to create an austenitic, antimagnetic, rust-proof steel alloy that, during hot working, and has a beneficial combination of characteristics without further tempering.

A process has been suggested (EP-0207068 B1) for improving, in particular, mechanical characteristics of amagnetic drill string parts in which a material is subjected to a hot and a cold forming, with the cold forming taking place at a temperature between 100° C. and 700° C. and a degree or deformation of at least 5%.

SUMMARY OF THE INVENTION

The invention provides a material, process of making and methods of use.

In an aspect of the invention, a material is provided that is paramagnetic, corrosion-resistant, including particularly in media having high chloride concentrations, and having high yield strength, strength, and ductility, the material comprising carbon, silicon, chromium, manganese, nitrogen, and optionally, nickel, molybdenum, copper, boron, carbide-forming elements (e.g. group 4 and 5 elements), and the balance can include iron, and possibly smelting-associated tramp elements, and impurities. The material is preferably substantially completely austenitic.

Thus, in one aspect, the present invention provides an austenitic, paramagnetic material with good corrosion resistance, in particular in media with high chloride concentrations, high yield strength, strength, and ductility, comprising (in wt-% based on total material weight): up to about 0.1 carbon; from about 0.21 to about 0.6 silicon; greater than about 20 to less than about 30 manganese; greater than about 0.6 to less than about 1.4 nitrogen; from about 17 to about 24 chromium; up to about 2.5 nickel; up to about 1.9 molybdenum; up to about 0.3 copper; up to about 0.002 boron; up to about 0.8 of carbide-forming elements; the balance including iron; and substantially no ferrite content. Preferably, the material is hot-formed to a degree of deformation of at least about 3.5 times and is further formed (i.e., cold-formed) below the deposit temperature of nitrides as well as associated phases, but at elevated temperature, e.g., greater than about 350° C.

The material more preferably comprises: less than about 0.06 wt-% carbon; less than about 0.49 wt-% silicon; from about 19 to about 22 wt-% chromium; from about 21.5 to about 29.5 wt-% manganese; from about 0.64 to about 1.3 wt-% nitrogen; from about 0.21 to about 0.96 wt-% nickel; from about 0.28 to about 1.5 wt-% molybdenum.

Preferred embodiments include those materials exhibiting relative magnetic permeability of less than about 1.05, especially less than about 1.016; yield strength $R_{P0.2}$ of more than about 700 N/mm$^2$ at room temperature; notch impact strength at the same temperature of over about 52 J; FATT of less than about −25° C.; fatigue strength under reversed stresses greater than about ±400 N/mm$^2$ at N=10$^7$ load alternation; pitting corrosion potential in neutral solutions at room temperature of greater than about 700 mV$_H$/1000ppm chlorides; pitting corrosion potential in neutral solutions at room temperature of greater than about 200 mV$_H$/80000ppm chlorides; grain structure quality grade of DUAL or better in the oxalic acid test according to ASTM-A262.

The material of the invention can be very beneficially used, for example, in connection with oil field technology and equipment, such as for bore rods and drilling string components as well as for precision-forged components, and for high strength attachment and connection elements.

In another aspect, the invention provides a process utilizing novel alloying technology that includes a deformation and synergistically results in production of a ferrite-free material that is paramagnetic with greater reliability and reproducibility, is corrosion-resistant, particularly in media with high chloride concentrations, and has high yield strength, strength, and ductility.

For example, in an aspect, the present invention provides a process of producing a material from an alloy, the material preferably comprising (in terms of wt-% based on total material weight) up to about 0.1 carbon; about 0.21 to about 0.6 silicon; about 17 to about 24 chromium; manganese; nitrogen; optionally up to about 2.5 nickel; optionally up to about 1.9 molybdenum; optionally up to about 0.3 copper; optionally up to about 0.002 boron; and optionally up to about 0.8 of at least one carbide-forming elements, e.g. from groups 4 and 5 of the periodic system. The balance can include iron, smelting-associated tramp elements, and impurities. Manganese is preferably incorporated in the material at from greater than about 20% to less than about 30% by weight. Nitrogen is preferably incorporated at from greater than about 0.6% to less than about 1.4% by weight.

In another aspect of the invention, a process is provided, wherein an alloy is smelted with introduction of manganese and nitrogen, allowed to solidify under atmospheric pressure to produce an ingot or casting, and the ingot or casting formed thereby, is subjected to a hot forming or forging and subsequently actively cooled at an increased rate, whereupon a further forming (i.e., cold-forming) of the piece occurs at a lower temperature, and then the formed part is allowed to cool to room temperature. The ingot or casting can be produced by an electroslag remelting process.

In a preferred embodiment the ingot or casting is subjected to an intermediate annealing after the hot-forming at temperature at least about 850° C. and subsequently to a cooling at an increased rate.

Preferably, the hot-forming introduces a degree of deformation of at least about 3.5 times and the further forming is conducted to a deformation of less than about 35%, more preferably about 5% to about 20%. The further forming is preferably carried out at temperature in the range of about 400 to 500° C.

Preferably, the cooling at an increased rate is an intensified cooling to and maintenance at a temperature below about 600° C. and, after the temperature has equalized, over its cross section, is conducted to the further forming.

Other exemplary embodiments and advantages of the present invention may be ascertained by reviewing the present disclosure.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the tables making apparent to those skilled in the art how the several forms of the present invention may be embodied in practice.

In an aspect of the invention, a material is provided that is paramagnetic, corrosion resistant, including in particular in media with high chloride concentrations, and having a high yield strength, strength, and ductility, the material comprising carbon, silicon, chromium, manganese, nitrogen, and optionally, nickel, molybdenum, copper, boron, carbide-forming elements, and the balance including iron, smelting-associated tramp elements, and impurities. The material is preferably substantially completely austenitic. A process for producing the material and beneficial representative methods of use are provided.

While not limiting to the invention, some component characteristics and preferred component ratios are described as follows:

Carbon content of the alloy preferably has an upper limit of about 0.1 wt-% because substantially higher contents can lead to pitting and corrosion in chloride-containing media as well as to an intercrystalline corrosion of parts manufactured therefrom. Adherence to this upper limit, preferably with carbon content restricted to about 0.06 and more preferably about 0.05 wt-%, inhibits chemical corrosion even though carbon increases yield strength and has a strong austenite-forming effect.

Silicon should be present in the metal as a deoxidation metal with a concentration of preferably about 0.21 wt-% to about 0.6 wt-%. Substantially higher contents of silicon can lead to nitride formation and to a decrease in resistance of the material to stress corrosion. Because silicon also has a strong ferrite-forming effect, higher contents can negatively influence magnetic permeability as well. Advantageously, a maximum concentration of about 0.48 wt-% silicon is utilized.

In order to achieve a desired corrosion resistance with greater certainty, chromium contents of greater than about 17 wt-%, preferably greater than about 19 wt-%, are preferred. While chromium increases the solubility of the alloy for nitrogen, it also has a ferrite-forming effect and is thus unfavorable with regard to the desired amagnetic or paramagnetic behavior of the material, such that the highest preferred chromium concentration is about 24 wt-%, more preferably about 22 wt-%. The corrosion behavior, in particular resistance to stress corrosion and pitting, is affected by the chromium content of the alloy. Here, it is preferred that a largely homogeneous chromium distribution is present in the material; in other words, so-called weak points of the passive layer due to segregations and inclusions are prevented.

Nickel is able to improve the mechanical values of the alloy and the stability of the austenitic structure. Optional nickel contents up to about 2.5 wt-% are suitable, but contents below about 0.96 wt-% are more preferable for sufficiently good corrosion characteristics, in particular with regard to stress corrosion. By utilizing optional low nickel contents of from about 0.21 wt-% up to the upper values mentioned above, it is possible to achieve an increase in yield strength without disadvantages in corrosion behavior of the desired alloy.

The alloy element molybdenum improves resistance of the material to corrosion, in particular to chloride-induced crevice corrosion and pitting. However, because this element is a strong ferrite former and a similar carbide former as well as a former of associated phases, the preferred upper limit for molybdenum is about 1.9 wt-%, more preferably about 1.5 wt-%. Low contents of from about 0.28 wt-% molybdenum up to the upper values mentioned above can bring about advantages with respect to chemical corrosion, for segregation-free austenitic structure of the grain.

Copper, which is often effective against corrosion attacks, has shown itself at high levels to have an adverse effect in the alloy of the present invention. Materials in which copper contents are preferably less than about 0.3 wt-%, and more preferably less than about 0.25 wt-% are preferred in order to achieve a desired degree of corrosion resistance.

In order to improve the hot-forming behavior of the material, boron can optionally be added to the alloy in an amount up to about 0.002 wt-%, preferably up to about 0.0012 wt-%. Substantially larger amounts of boron cause grain boundary deposits, brittleness phenomena, and undesired grain structures.

Low contents of carbide-forming elements, e.g. elements from groups 4 and 5 of the periodic system, are useful for preventing stress corrosion and pitting. These elements (e.g., Ti, Zr, Hg, V, Nb, Ta) are extremely strong carbide and nitride and/or carbon nitride formers and, as a whole, preferably are present in amounts of less than about 0.8 wt-%, more preferably less than about 0.48 wt-%. Substantially higher concentrations can cause deposits and thus weak points in the passive layer on the surface of a tool, which can impair corrosion resistance.

In alloying, nitrogen represents a strong austenite former. Furthermore, yield strength and resistance of the material to pitting and crevice corrosion are increased by nitrogen. However, nitrogen is only soluble to a limited extent in iron-based alloys, with the solubility limit being raised by increasing chromium and manganese contents. Essentially, therefore, the chromium, manganese, and nitrogen contents of the alloy should be viewed synergistically for characteristics of the material of the invention.

As described above, the material has a preferred chromium content of from about 17 to about 24 wt-%, more preferably from about 19 to about 22 wt-%, mainly for reasons of corrosion resistance and paramagnetic behavior. Manganese content of from greater than about 20 wt-% to less than about 30 wt-%, with more preferred concentration ranges of from about 20.5 to about 29.5, especially about 21.5 to about 25.0 wt-%, is provided with a purpose of increasing nitrogen solubility, on the one hand, and for stabilizing the austenitic and/or ferrite-free grain structure, on the other hand. Finally, nitrogen content of greater than about 0.6 wt-% to less than about 1.4 wt-% essentially serves to allow high yield strengths to be achieved.

Preferred nitrogen concentration ranges are: about 0.64 to about 1.3 wt-%, especially about 0.72 to about 1.2 wt-%. Because of a sudden decrease in the nitrogen solubility in the alloy at solidification, low manganese contents of about 20 wt-% and lower as well as high nitrogen concentrations of about 1.4 wt-% and higher, can lead to porous and/or permeable castings. At manganese contents of about 30 wt-% and higher, as well as at nitrogen contents of about 0.6 wt-% and lower, desired high yield strengths are not achieved and embrittlement of the material can occur.

In another aspect of the invention, a preferred process is provided, wherein an alloy is smelted, allowed to solidify under atmospheric pressure to produce an ingot or casting, and the ingot or casting formed thereby, is subjected to a hot forming or forging at a forming temperature of at least about 850° C. and subsequently cooled at an increased rate, i.e. actively cooled, whereupon a further forming (cold-forming) occurs at a temperature below about 600° C., and then the piece that has been formed is allowed to cool to room temperature.

When, as is provided for reasons of material quality and cost-efficiency, an ingot or casting is solidified at atmospheric pressure, it can be subjected to a diffusion annealing that serves to homogenize the microstructure and/or to even out microsegregations. This annealing can, for example, be performed at a temperature of about 1200° C. for a duration of up to about 60 seconds.

Hot-forming usually occurs by forging, with the forming temperature being at least about 850° C. in order to ensure a correspondingly favorable recrystallization of the mixed grain. A forged piece formed in this manner is cooled at an increased rate, such as from the forging heat. This cooling, which serves to prevent deposits, in particular at the grain boundaries, can be performed in a water tank or using a once-through cooling path. Here, it can also be advantageous if, after the hot forming, the ingot is subjected to an intermediate annealing at an annealing temperature at least about 850° C. and subsequently to a cooling at an increased rate because any deposits that may have formed will be brought back into solution thereby.

A forged piece is then further formed (cold-formed) at a temperature of less than about 600° C., whereupon a hardening of the material occurs, in particular producing a desired increase in yield strength. In spite of the high chromium and especially manganese contents, the material surprisingly remains completely austenitic and/or ferrite-free, i.e., an expected partial flipping over while forming a grain structure with deformation martensite does not occur. Here, it has proven to be useful if, in the cold-forming, the deformation of the forged piece occurs at elevated temperature, albeit under about 600° C., and the deformed piece is subsequently allowed to cool to room temperature. From the point of view of production engineering and also with regard to improved homogeneity and material quality, it can be favorable if the ingot or casting is produced according to an electroslag remelting process.

Material quality can be further increased if, in the hot-forming, the ingot or casting is hot-formed to a degree of deformation of at least four times, the degree defined as: original cross section divided by final cross section. Thereby, a fine, recrystallized, uniform, ferrite-free austenite grain is achieved.

After cooling at an increased rate from a temperature of at least about 850° C., which serves to prevent deposits from forming, the forged piece is deformed in the cold-forming with a deformation of less than 35%, defined as original cross section minus final cross section divided by original cross section times 100, whereby the yield strength and the strength of the material are increased. With regard to a uniform increase in mechanical values, a recrystallization-free deformation more preferred range of about 5 to about 20% has emerged.

For performing the cold forming as well as for an effective, far-reaching, and embrittlement-free improvement of material characteristics and a reliable prevention of deformation martensite, it has been shown to be particularly advantageous to form the forged piece in the cold-forming at a temperature in the range of about 400 to about 500° C.

An austenitic, paramagnetic material produced according to the inventive process, with the above-mentioned composition, with good corrosion characteristics that has been hot-formed to a degree of at least about 3.5 times and is cold-formed above a temperature of about 350° C. but below the deposit temperature of nitrides as well as associated phases has minimal traces of ferrite, has virtually no ferrite content in the preferred regions of the composition, and behaves in an essentially paramagnetic manner with a relative permeability $\mu r$ of less than 1.05, more preferably less than 1.0 1 6.

Preferably, the yield strength $R_{P0.2}$ of the material at room temperature is greater than about 700 N/mm$^2$. The value for notch impact strength at room temperature is preferably greater than about 52 J and its FATT (fracture appearance transition temperature) is preferably lower than about −25° C. Moreover, the material of the invention has a fatigue strength under reversed stresses of preferably greater than about ±400 N/mm$^2$ at N=10$^7$ load alternation and preferably has a pitting potential in neutral solutions (corresponding to ASTM G5/87) at room temperature of greater than about 700 $mV_H$/1000ppm chlorides and/or about 200 $mV_H$/80000ppm chlorides.

In Table 1, components of representative inventive compositions A–E are listed as well as comparison materials 1–6. Deformation data is also provided.

In Table 2, results with respect to magnetic characteristics, mechanical values, and corrosion behavior are summarized.

Samples 2 and A were produced from a steel that was smelted in an induction oven and cast into ingots under protective gas. Samples 1, 3 and B–E stem from electroslag remelting material.

While the materials of samples 1–3 have good magnetic data, they have low yield strengths and strength values. Good ductility and sufficient FATT and corresponding oxalic acid test results are accompanied by low pitting corrosion potentials, whereby the materials are eliminated due to an insufficient characteristic profile for high stresses. The causes therefor lie in the low chromium and manganese contents as well as in the resulting low nitrogen concentration.

While the material of sample 2 has a sufficiently high chromium content, low manganese and similar nitrogen values cause particularly poor corrosion resistance.

Samples A–E, which were produced using a process according to the invention, are clearly drastically improved in the totality of their performance characteristics. Synergistically, the respective concentrations of the alloy elements, which are attuned to one another, and the strengthening cold-forming of the material, which was produced free of deposits, result in superior corrosion resistance with low relative magnetic permeability and a substantial increase in the strength values thereof. This is also shown by the test results and measured values of the freely obtained alloy samples 4–6.

Advantages achieved by the invention include, with high cost effectiveness as far as material costs and the production process are concerned, maximum corrosion resistance and a desirably paramagnetic behavior of the material are achieved using optimized alloying technology, with the high mechanical characteristic values of the material, in particular the yield strength, being further substantially improved without disadvantageous effects on the characteristics mentioned above, by a specifically structured cold-forming at an elevated temperature.

TABLE 1

| | Chemical Composition | | | | | | | | | Hot-Forming | | | Cold-Forming | |
|---|---|---|---|---|---|---|---|---|---|---|---|---|---|---|
| Sample | C | Si | Mn | Cr | Ni | Mo | Cu | B | N | Degree of Deformation (umes) | Forming Temperature [° C.] | Cooling | Deformation [%] | Forming Temperature [° C.] |
| 1 | 0.023 | 0.46 | 19.71 | 13.31 | 0.88 | 0.44 | 0.10 | 0.0016 | 0.30 | 5.1 | 1020/910 | air | 17 | 420 |
| 2 | 0.041 | 0.26 | 19.56 | 18.40 | 1.06 | 0.17 | 0.16 | 0.0014 | 0.55 | 4.5 | 1040/930 | air | 14 | 410 |
| 3 | 0.032 | 0.40 | 19.10 | 13.00 | 0.60 | 0.35 | 0.09 | 0.0014 | 0.27 | 3.9 | 990/870 | air | 15 | 390 |
| A | 0.05 | 0.23 | 21.88 | 19.90 | 0.89 | 0.21 | 0.09 | 0.0011 | 0.75 | 4.5 | min. 850 | water | 8 | 490 |
| B | 0.04 | 0.35 | 23.40 | 20.90 | 0.80 | 0.31 | 0.08 | 0.0008 | 0.92 | 4.9 | min. 850 | water | 12 | 470 |
| C | 0.05 | 0.28 | 25.20 | 22.10 | 1.10 | 0.70 | 0.09 | 0.0009 | 1.07 | 4.8 | min. 850 | water | 10 | 450 |
| D | 0.05 | 0.26 | 28.10 | 23.70 | 0.87 | 0.28 | 0.07 | 0.0007 | 1.26 | 5.0 | min. 850 | water | 15 | 490 |
| E | 0.05 | 0.34 | 29.90 | 21.70 | 0.75 | 0.24 | 0.07 | 0.0008 | 0.88 | 4.5 | min. 850 | water | 16 | 520 |
| 4 | 0.03 | 0.56 | 19.70 | 12.60 | 0.10 | 0.13 | 0.08 | not determined | 0.28 | not determined | not determined | not determined | not determined | not determined |
| 5 | 0.02 | 0.80 | 18.00 | 14.30 | 1.16 | 0.40 | 0.11 | not determined | 0.25 | not determined | not determined | not determined | not determined | not determined |
| 6 | 0.03 | 1.68 | 17.10 | 12.80 | 2.25 | 0.77 | 0.10 | not determined | 0.27 | not determined | not determined | not determined | not determined | not determined |

A, B, C, D, E → Materials According to the Invention
1 to 3 and 4 to 6 → Comparison Materials

TABLE 2

| | Relative | | | Fatigue[1]) | Ductility (ISO-V) | | Oxalic | Pitting Corrosion Potential [mV] | |
|---|---|---|---|---|---|---|---|---|---|
| Sample | Magnetic Permeability | Rp0.2 [N/mm$^2$] | Rm [N/mm$^2$] | Strength Under Reversed Stresses | 20° [Joule] | FATT [° C.] | Acid Test ASTM-A262 | 1000 ppm C1 | 80000 ppm C1 |
| 1 | 1.002 | 836 | 911 | ± 350 | 177 | −30 | STEP | 195 | −10 |
| 2 | 1.003 | 920 | 1099 | ± 370 | 148 | −28 | DUAL | 390 | 75 |
| 3 | 1.002 | 761 | 881 | ± 330 | 191 | −25 | STEP | 205 | −20 |
| A | 1.002 | 1110 | 1320 | ± 420 | 115 | −30 | STEP | 750 | 280 |
| B | 1.001 | 1250 | 1420 | ± 430 | 100 | −28 | STEP | 820 | 320 |
| C | 1.002 | 1370 | 1501 | ± 450 | 98 | −26 | STEP | 840 | 320 |
| D | 1.003 | 1310 | 1470 | ± 450 | 101 | −28 | STEP | 880 | 330 |
| E | 1.002 | 1221 | 1410 | ± 430 | 120 | −26 | STEP | 800 | 300 |
| 4 | 1.006 | 801 | 908 | ± 340 | 188 | −26 | DUAL | 100 | −95 |
| 5 | 1.004 | 797 | 916 | ± 330 | 196 | −25 | DUAL | 170 | −70 |
| 6 | 1.006 | 795 | 871 | ± 320 | 142 | −21 | DUAL | 220 | −180 |

A,B,C,D,E →
1 to 3 and 4 to 6 →
[1]) Values at N = $10^7$ load alternation without break It is noted that the foregoing detailed description and examples have been provided merely for the purpose of explanation and are in no way limiting of the present invention. While the present invention has been described with reference to a exemplary embodiments, it is understood that the words which have been used herein are words of description and illustration, rather than words of limitation. Numerous, changes can be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims and spirit of the invention.

What is claimed:

1. Austenitic, paramagnetic material with good corrosion resistance in media with high chloride concentrations, high yield strength, strength, and ductility, comprising (in wt-%):

up to about 0.1 carbon;

about 0.21 to about 0.6 silicon;

greater than about 20 to less than about 30 manganese;

greater than about 0.6 to less than about 1.4 nitrogen;

about 17 to about 24 chromium;

up to about 2.5 nickel;

up to about 1.9 molybdenum;

up to about 0.3 copper;

a positive amount of up to about 0.002 boron;

up to about 0.8 carbide-forming elements;

the balance including iron; and substantially no ferrite content;

wherein the material is hot-formed to a degree of deformation of at least about 3.5 times, actively cooled, and is cold-formed below the deposit temperature of nitrides, but at elevated temperature, the cold forming resulting in a deformation of about 5% to about 20%.

2. The material of claim 1, wherein the elevated temperature is greater than about 350° C.

3. The material according to claim 1, wherein the material contains less than about 0.06 wt-% carbon.

4. The material according to claim 1, wherein the material contains less than about 0.49 wt-% silicon.

5. The material according to claim 1, wherein the material contains about 19 to about 22 wt-% chromium.

6. The material according claim 1, wherein the material contains about 21.5 to about 29.5 wt-% manganese.

7. The material according claim 1, wherein the material contains about 25 wt-% manganese.

8. The material according to claim 1, wherein the material contains about 0.64 to about 1.3 wt-% nitrogen.

9. The material according to claim 1, wherein the material contains about 0.72 to about 1.2 wt-% nitrogen.

10. The material according to claim 1, wherein the material contains about 0.21 to about 0.96 wt-% nickel.

11. Material according to claim 1, wherein the material contains about 0.28 to about 1.5 wt-% molybdenum.

12. The material according to claim 1, wherein the material has a relative magnetic permeability of less than about 1.05.

13. The material according to claim 1, wherein the material has a relative magnetic permeability of less than about 1.016.

14. The material according to claim 1, wherein the material has a yield strength $R_{P0.2}$ of more than about 700 N/mm$^2$ at room temperature, a notch impact strength at the same temperature of over about 52 J, and a FATT of less than about −25° C.

15. The material according to claim 1, wherein the material has a yield strength $R_{P0.2}$ of more than about 700 N/mm$^2$ at room temperature, a notch impact strength at the same temperature of over about 120 J, and a FATT of less than about −25° C.

16. The material according to claim 1, wherein the material has a fatigue strength under reversed stresses greater than about ±400 N/mm$^2$ at N=10$^7$ load alternation.

17. The material according to claim 1, wherein the material has a pitting corrosion potential in neutral solutions at room temperature of greater than about 700 mV$_H$/1000ppm chlorides.

18. The material according to claim 1, wherein the material has a pitting corrosion potential in neutral solutions at room temperature of greater than about 200 mV$_H$/80000ppm chlorides.

19. The material according to claim 1, wherein the material in the oxalic acid test according to ASTM-A262, has a grain structure quality grade of DUAL or better.

20. The material according to claim 1, wherein the material in the oxalic acid test according to ASTM-A262, has a grain structure quality grade of STEP.

21. A process for producing an austenitic, paramagnetic material with good corrosion resistance in media with high chloride concentrations, high yield strength, strength, and ductility, comprising:

smelting an alloy to form an ingot or casting, the alloy comprising (in wt-%);

up to about 0. 1 carbon; about 0.21 to about 0.6 silicon; greater than about 20 to less than about 30 manganese; greater than about 0.6 to less than about 1.4 nitrogen; about 17 to about 24 chromium; up to about 2.5 nickel; up to about 1.9 molybdenum; up to about 0.3 copper; a positive amount of up to about 0.002 boron; up to about 0.8 carbide-forming elements; the balance including iron; and substantially no ferrite content;

hot-forming the ingot or casting to a degree of deformation of at least about 3.5 times;

actively cooling; and cold-forming below the deposit temperature of nitrides, but at elevated temperature, to a deformation of about 5% to about 20%.

22. The process of claim 21, wherein the hot-forming is done at a temperature of at least about 850° C., and the cold forming is done at a temperature of below about 6000° C.

23. The process of claim 22, wherein the ally comprises (in wt. %):

up to about 0.06 carbon; about 0.21 to about 0.48 silicon; about 19 to about 22 chromium; about 0.21 to about 0.96 nickel; about 0.28 to about 1.5 molybdenum; up to about 0.25 copper; up to about 0.0012 boron; up to about 0.48 of at least one element selected from carbide-forming elements; about 20.5 to about 29.5 wt. % manganese; and about 0.64 to about 1.3 wt. % nitrogen.

24. The process of claim 23, wherein the carbon amount is up to about 0.05 wt %.

25. The process of claim 21, wherein the manganese amount is about 21.5 to about 25.0 wt-% and the nitrogen amount is about 0.72 to about 1.2 wt-%.

26. The process of claim 21, wherein the ingot or casting is produced by an electroslag remelting process.

27. The process of claim 22, wherein the ingot or casting is produced by an electroslag remelting process.

28. The process of claim 21, wherein, alter the hot-forming, the ingot or casting is subjected to an intermediate annealing at temperature of at least about 850° C.

29. The process of claim 21, wherein the cold-forming is carried out at temperature in the range of about 400 to 500° C.

30. The process of claim 21, wherein the active cooling is carried out to a temperature below about 600° C. and the temperature is equalized over a cross-section of the ingot or casting.

31. A component of oil field equipment comprising the material of claim 1.

32. The component of claim 31, which is selected from bore rods, drilling string components, or precision-forged components.

33. An attachment or connection element comprising the material of claim 1.

34. A component of oil field equipment manufactured according to the process of claim 21.

35. The component of claim 34, which is selected from bore rods, drilling string components, or precision-forged components.

36. An attachment or connection element manufactured according to the process of claim 21.

* * * * *